United States Patent [19]

Fullenkamp

[11] Patent Number: 4,610,118

[45] Date of Patent: Sep. 9, 1986

[54] MEDICAL SERVICE COLUMN

[75] Inventor: Eugene H. Fullenkamp, Batesville, Ind.

[73] Assignee: Hill-Rom Company, Inc., Batesville, Ind.

[21] Appl. No.: 689,632

[22] Filed: Jan. 8, 1985

[51] Int. Cl.[4] ..... E04H 1/00

[52] U.S. Cl. ..... 52/240; 52/243.1; 312/209

[58] Field of Search ..... 52/243.1, 240; 312/209; 248/354.1, 354.3

[56] References Cited

U.S. PATENT DOCUMENTS

| | | | |
|---|---|---|---|
| 1,876,528 | 9/1932 | Walters | 52/243.1 |
| 2,504,291 | 4/1950 | Alderfer | 248/354.3 X |
| 3,228,646 | 1/1966 | Hinrichs et al. | 248/354.3 |
| 4,449,876 | 5/1984 | Glanton | 248/354.3 X |
| 4,475,322 | 10/1984 | Russo et al. | 312/209 X |

*Primary Examiner*—Carl D. Friedman

*Attorney, Agent, or Firm*—F. Kristen Koepcke; Brian J. Leitten

[57] ABSTRACT

An improved medical service column is described. The improved column is of a fixed height yet may be mounted or secured in a variety of patient room environments with floor-to-ceiling heights of substantially varying lengths. By employing guide tubes or jack screw assemblies of various lengths, the single medical service column may be adjustably mounted in rooms of varying height. A shroud or cover to render the upper section of the medical service column and the ceiling connecting area aesthetically pleasing is also described. The improvement permits employing a single medical service column of a fixed height to provide services to a patient or to a patient bed area at a standard or desired height with respect to the patient room floor.

9 Claims, 4 Drawing Figures

MEDICAL SERVICE COLUMN

BACKGROUND AND OBJECTS OF THE INVENTION

The present invention relates to medical service columns used in patient care environments. The medical service column is a free-standing device having front and rear sides with service outlets mounted on at least one side. These service outlets are for connection with, e.g., fluid and electrical conduits. The medical service column is positionable in any convenient location in a patient room, e.g., adjacent to a corner of the head of the patient's bed. This permits medical services to be located approximate to the patient and at a desired height with respect to the patient and the patient bed.

In the past, medical service columns have been constructed in a variety of heights to accomodate patient rooms of various ceiling heights. This was particularly disadvantageous in that medical service columns were essentially customized for a particular patient room or patient care facility. This customization resulted in substantial expense and manufacturing difficulties, including short production runs and substantial variations in manufacturing processes required to manufacture particular medical service columns. Only small variations in ceiling height could be accomodated for a medical service column of a particular height. Screw jack and horizontal pad assemblies were employed at the base of the medical service columns. These screw jack and pad assemblies permitted minor tightening or tensioning of the medical service column with respect to the patient room to insure a tight fit. Even with these minor adjustments, it was still necessary to provide medical service columns of varying heights for patient room environments of minor height differences.

Typically, prior medical service columns included at least one pair of vertically extending channels on either side of the column. Each channel extended substantially the height of the column. In the base of the medical service column, screw jack and horizontal pad or plate assemblies were located directly beneath at least one vertical channel on either side of the columns. The screw jack and horizontal pad assemblies comprised a threaded shaft with a nut welded thereto at a point along the shaft. One or two additional nuts were threaded onto the shaft and remained in a free condition. The threaded shaft or rod was placed in a vertical position with respect to the column and secured to the base, e.g., by welding or by placement in a boss or retaining ring or cup. The horizontal pad or plate was placed above the welded nut with the top surface of the nut abutting the bottom surface of the plate and with the top portion of the threaded shaft extending through an opening in the central portion of the plate. The plate was configured to abut with the bottom portion of the vertically extending track to support the same and to permit slight movement or adjustment of the vertical track with respect to the floor and ceiling surfaces by tightening the lower nut or nuts.

In another prior embodiment, the welded nut is eliminated and two free moving nuts are threaded onto the shaft. By adjustment of one of the nuts in an upward fashion into contact with the lower surface of the plate, the columns could be tensioned into position by movement over a slight distance. The second nut in both prior medical service columns functioned as a tightening nut to hold the first nut in place. The horizontal plate or pad was connected to the bottom of the vertically extending channel, e.g., by screws or by a force fit. In one prior medical service column, rods welded around the perimeter of the upper service of the horizontal pad fit snugly into the inner diameter of the vertically extending channel. A cover or shroud was put in place over the screw jack and horizontal plate assembly for aesthetic purposes.

In these prior medical service columns, ceiling attachment was made in a variety of manners. For example, a rectangular shaped ring mounted in the upper portion of the column could be mated, e.g., by bolting, to a similarly shaped ring mounted in the patient room ceiling. Alternatively, hanger arms or claws could be extended from the top portion of the service column, which hanger claws were physically slid over ears or protrusions extending from the inner perimeter of a generally rectangular shaped mounting ring located in the patient room ceiling. Once in place, the service column and ceiling ring could be retained in place, e.g., by bolts.

Thus, the present invention relates in particular to an improved medical service column which eliminates the problems of prior medical service columns and which permits a medical service column of a fixed, single height to be employed in patient room environments having a broad variety of floor-to-ceiling heights.

It is, therefore, an objective of the present invention to provide a single, improved medical service column with a universal mounting capacity so that the single column can be placed in the patient rooms of varying floor-to-ceiling heights.

Another object of the present invention is to provide a medical service column which can be mounted without the use of a horizontal plate to support and co-act with the vertically extending channels of the medical service column.

Yet another object of the present invention is to provide a single medical service column capable of being mounted in patient rooms of varying floor-to-ceiling heights while maintaining the services provided by the column at a fixed or particular height with respect to patient room floor and therefore with respect to the patient or patient bed.

SUMMARY OF THE INVENTION

These and other objects are achieved by the present invention, which is directed to an improved medical service column of a single fixed height. The present invention comprises a mounting section for adjustably mounting the medical service column at the top of the column to the patient room ceiling. By providing mounting sections of several different lengths, and by providing a shroud or cover for the upper portion of the medical service column, a medical service column of a single height may be employed in a broad variety of patient room environments with differing floor-to-ceiling heights, delivering medical services at a fixed or particular height with respect to the patient room floor and therefore with respect to the patient or patient bed.

THE DRAWINGS

The objects and advantages of the present invention will become apparent from the following detailed description of the preferred embodiments thereof, in connection with the accompanying drawings in which like numerals designate like elements, and in which.

DETAILED DESCRIPTION OF THE PERFERRED EMBODIMENT OF THE INVENTION

Figure 1:
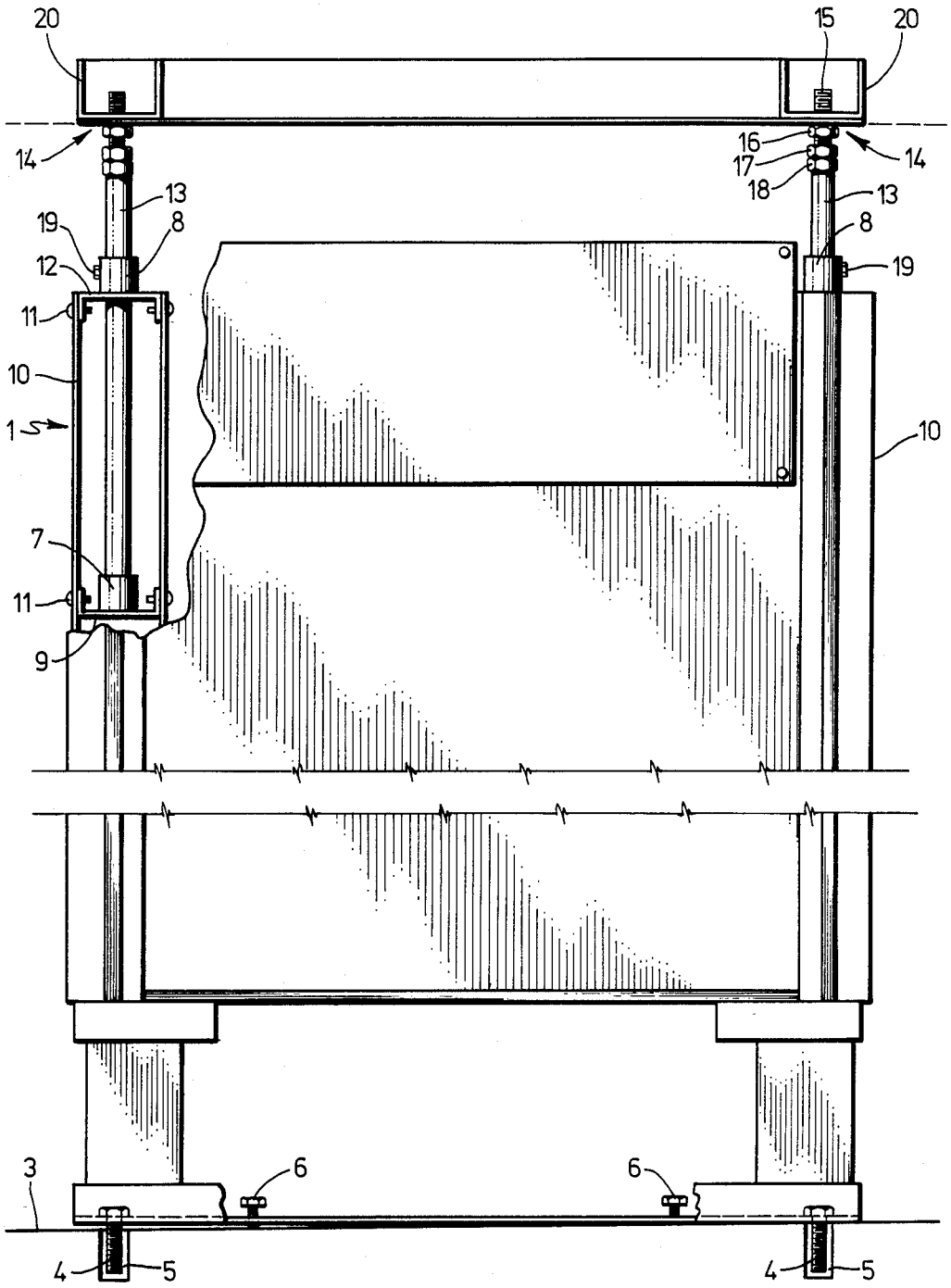
FIG. 1 is a front elevational view of the upper and lower sections of the improved medical service column of the present invention, in a partially assembled state.

In accordance with the present invention, there is provided an improved medical service column of a fixed height which may be installed in patient rooms having floor-to-ceiling heights which vary substantially. As may be seen in FIG. 1, the medical service column 1 is free standing and is mounted to the ceiling 2 and floor 3 of the patient room. Medical service column 1 is mounted to floor 3 in FIG. 1 by bolts 4 secured in bolt holes 5 in floor 3. Leveling of medical service column 1 is accomplished by leveling screws 6. In the upper section of medical service column 1, means are provided for mounting the medical service column to the ceiling of the patient room. Retaining and guide means are provided in the upper section of the medical service column. Mounting means are provided to cooperate with the retaining and guide means to mount the medical service column with respect to the patient room ceiling. The effective length of the mounting means may be adjusted over a substantial distance to provide for the connecting fit with the patient room ceiling. The mounting means is removably positioned in the retaining and guide means. Means attached to said mounting means are provided for securing the medical service column in position with respect to the patient room ceiling.

In one embodiment of the present invention, shown in FIG. 1, the retaining and guide means comprises an internal retaining cup 7 and a guide ring 8. The internal retaining cup 7 is mounted in some fashion to the horizontal surface of the medical service column. For example, the internal retaining cup may be welded to a U-shaped bracket 9 mounted to the interior of vertically extending channel 10. Bracket 9 may be attached to channel 10, e.g., by metal screws 11. A guide collar 8 may also be employed in the present invention to fix the direction and location of the mounting means. In FIG. 1, guide means 8 is shown as a collar or ring welded to a section of the medical service column. For example, guide ring 8 may be welded to inverted U-shaped bracket 12, which may be affixed to the interior of vertical channel 10 by, e.g., metal screws 11. Guide ring 8 is located between retaining cup 7 and the ceiling of the patient room.

The mounting means shown in FIG. 1 comprises a guide tube 13 and a jack screw assembly 14. Jack screw assembly 14 comprises a bar or rod, e.g., a threaded bar or rod 15 (see FIG. 2) and welded nut 16. Securing means, such as fasteners, e.g., movable nuts 17 and 18, are detachably mounted as screw jack assembly 14. Jack screw assembly 14, with securing means attached, is inserted into guide tube 13, which is in turn inserted through guide ring 8 into retaining cup 7. The guide tube is positioned and retained in guide ring 8 by set screw 19.

The upper portion of jack screw assembly 14 is inserted into an opening in the patient room ceiling. In FIG. 1, a ceiling retaining ring member 20 is mounted in the patient room ceiling and the upper section of jack screw assembly 14, i.e., the upper end of threaded rod 15, is inserted into an aperture (see aperture 21 in FIG. 2) in ceiling retaining ring member 20. Ceiling retaining ring member 20 may comprise two or more apertures 21.

Figure 2:
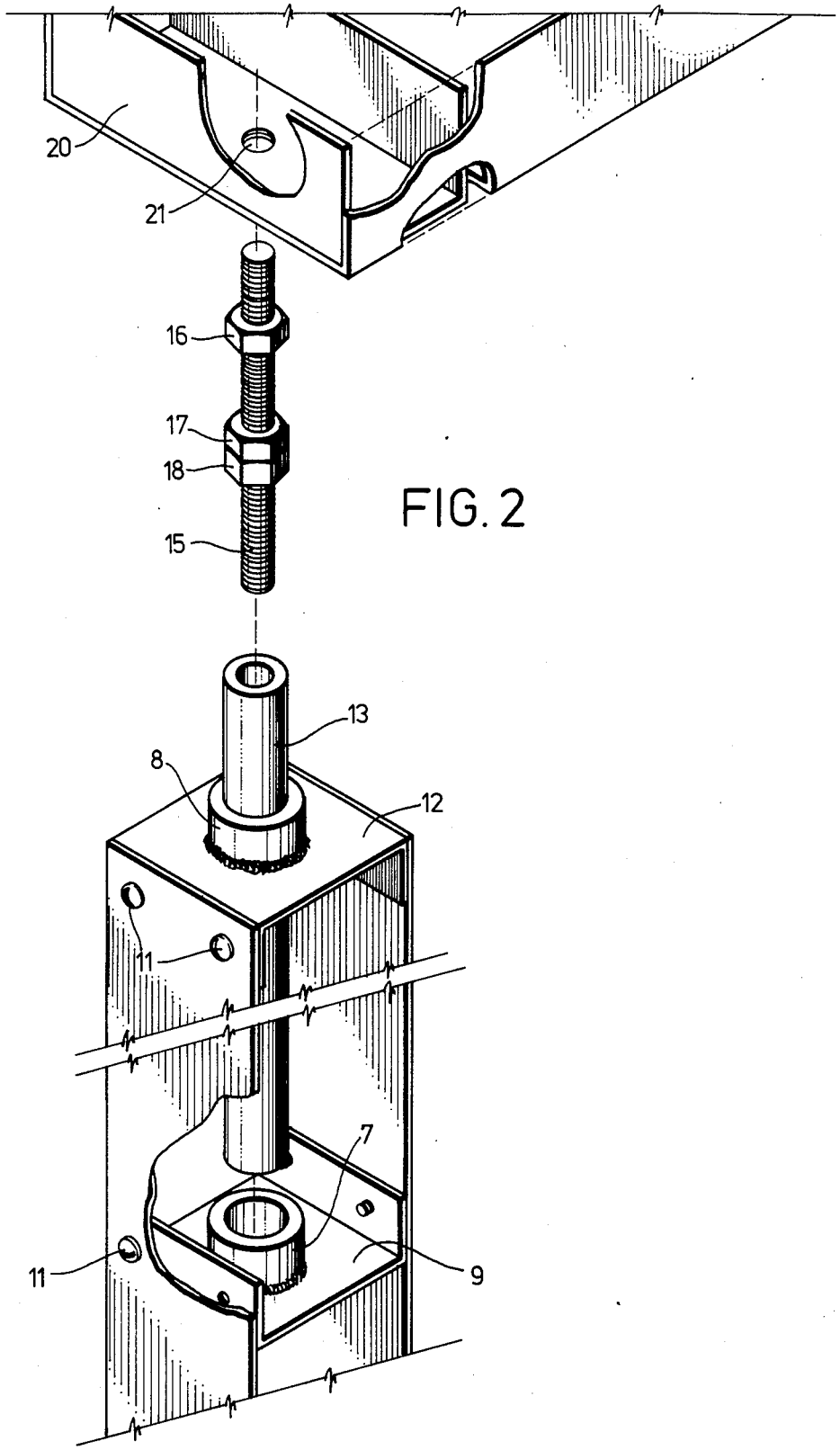
FIG. 2 is a perspective view of one part of the upper portion of the improved medical service column of the present invention.
Figure 3:
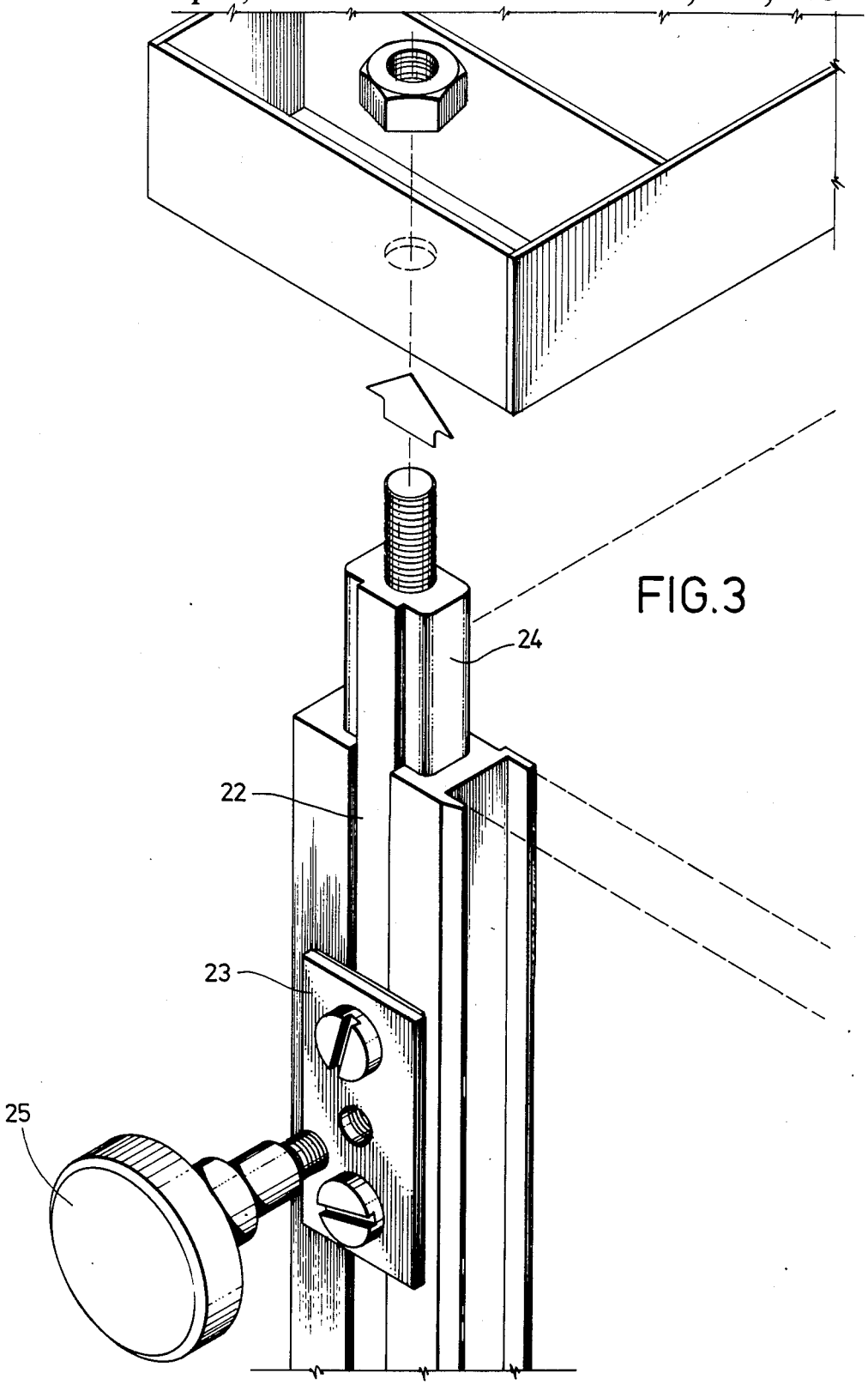
Figure 4:
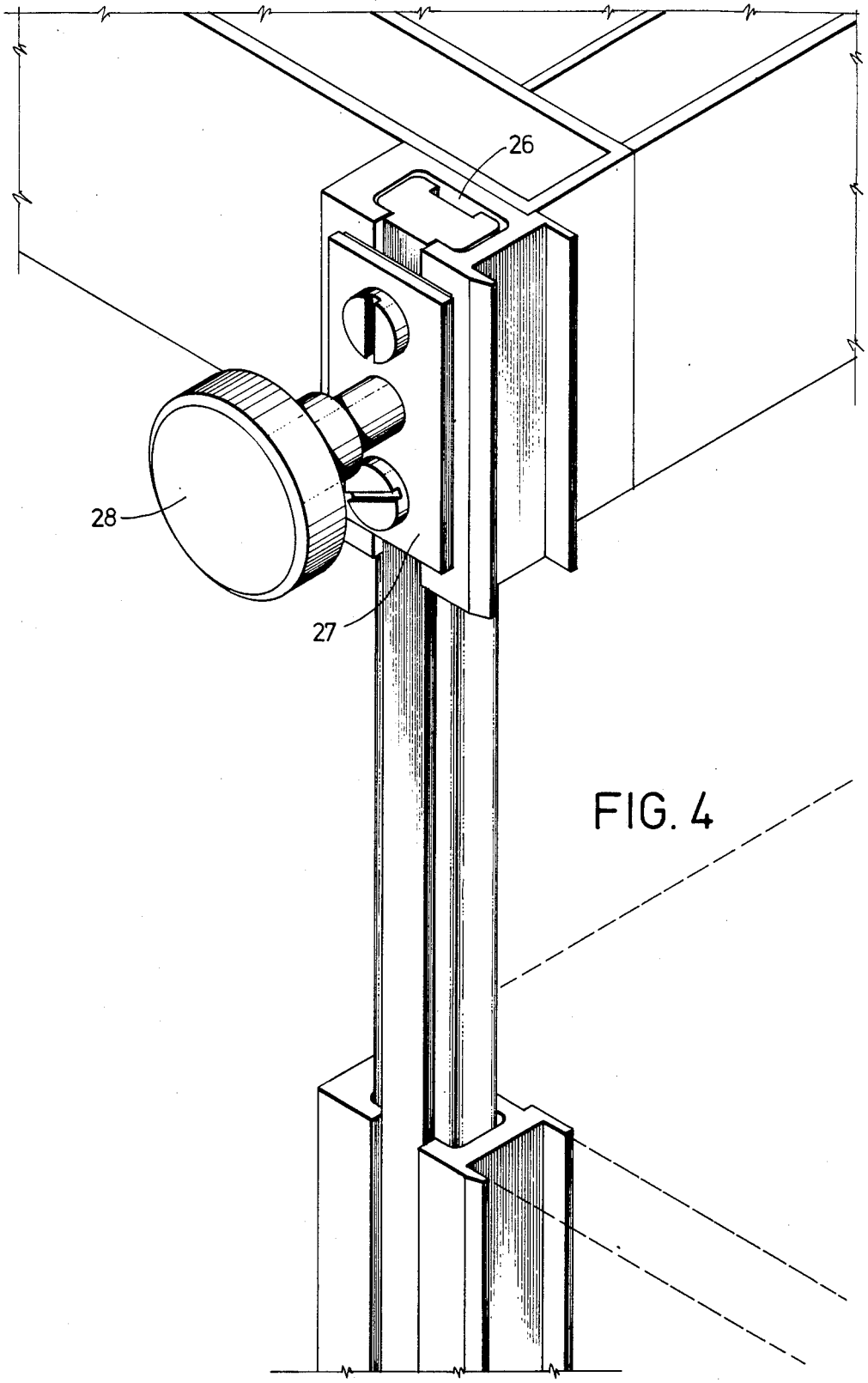

In installation, the medical service column is positioned below the ceiling retaining ring 20 (see FIG. 2). Guide tube 13 is inserted through guide ring 8, and one end of guide tube 13 is inserted into retaining cup 7. Set screw 19 is tightened to secure the guide tube in position. Jack screw assembly 14 with two jam nuts 17 and 18 movably positioned thereon is inserted into the guide tube 13.

Positioned directly below the ceiling retaining ring opening, the medical service column is moved into a vertical orientation and the jack screw assemblies and securing means are inserted into the openings in the ceiling ring. The securing means, i.e., bottom jam nuts 18 are then repositioned down on threaded bars 15 to contact the tops of guide tubes 13. Holding welded nuts 16 in position, bottom jam nuts 18 are tightened to firmly seat the jack screw assemblies against ceiling ring 20. Top jam nuts 17 are threaded down on top of jam nuts 18 to secure the medical service column in place. As earlier discussed, the medical service column is anchored in place at its bottom by anchor bolts 4. Once the medical service column has been mounted in place, a shroud or cover, e.g., a sheet metal cover, is positioned in place to enclose the exposed area between the top of the medical service column and the patient room ceiling. By employing a number of different length guide tubes and corresponding shrouds, a single height medical service column may be employed in a variety of patient rooms having differing floor-to-ceiling heights. Typically, three different length guide tubes may be employed to satisfy the floor-to-ceiling height requirements of most patient room environments.

Alternative embodiments of the present invention are envisioned. For example, the screw jack/guide tube assembly of the present invention may be positioned and secured in a number of different manners. One such manner takes advantage of the presence of at least one vertical track positioned on at least one face of the medical service column. At least one locking slide member may be attached to the lower end of guide tube 13, which may be configured in any convenient shape. The locking slide member is inserted into the vertical tracks and permitted to slide therein. Similar vertical tracks and locking slide members could be employed at the point of attachment to the ceiling, or the screw jack assembly discussed above may be employed. The locking slide members may further comprise a manual actuator for locking the slide member at selected vertical locations along the track.

In yet another embodiment of the present invention, a fixed length guide tube may be employed and a variable length jack screw assembly 14 may be used to accomodate various floor-to-ceiling patient room heights. It is also conceivable that the entire guide tube/jack screw assembly could be inverted and attached to the medical service column in that fashion.

Although the present invention has been described in connection with the preferred embodiments thereof, it will be appreciated by those skilled in the art that additions, modifications, substitutions and deletions not specifically described may be made without departing from the spirit and scope of the invention as defined in the appended claims:

What is claimed is:

1. In a medical service column for use in patient room environments, which column is free standing and has front and rear sides with service outlets mounted on at least one of said sides for connection with fluid and electrical conduits, the improvement comprising:

A. retaining and guide means positioned in the upper section of the medical service column for retaining a mounting means and guiding the same in the direction of the patient room ceiling, said retaining and guide means comprising a retaining cup mounted in the upper section of the medical service column in a location to permit the lower end of said mounting means to be inserted therein;

B. means for mounting the medical service column to the patient room ceiling, said mounting means comprising a guide tube and a screw jack assembly, said guide tube having the lower end thereof configured to be inserted into said retaining cup and said upper end configured to receive said screw jack assembly, said screw jack assembly comprising a threaded rod member, the lower end of said rod member being configured to be inserted into the upper end of said guide tube and the upper end of said rod member being configured to be inserted into an aperture in the patient room ceiling; and C. means attached to said mounting means for securing the medical service column in position with respect to the patient room ceiling said securing means comprising at least two fastening members attached to said threaded rod member, the upper of said fastening members being fixedly attached to said threaded rod member and the lower of said fastening members being threadedly attached to said rod member, and wherein said medical service column is held in position with respect to the patient room ceiling by tightening down on said lower fastening member unitl the upper fastening member abuts against the patient room ceiling and the lower end of the lower fastening member abuts against the upper end of said guide rod; whereby a single medical service column of a fixed height may be employed in patient room environments having varying floor-to-ceiling heights to provide medical services at fixed height with respect to the patient room floor.

2. The improvement according to claim 1 wherein said patient room ceiling comprises a ceiling retaining ring having said aperture therein.

3. The improvement according to claim 2 wherein said ceiling retaining ring is generally rectangular in shape.

4. The improvement according to claim 3 wherein said generally rectangular ceiling retaining ring comprises at least two apertures for receiving rod members.

5. The invention according to claim 1 wherein said fastening members comprise nuts and wherein said retaining and guide means further comprises at least one guide ring positioned between the patient room ceiling and said retaining cup, wherein said guide rod is inserted through said guide ring and held in position with respect to the medical service column thereby.

6. The improvement according to claim 1 wherein said medical service column further comprises at least one vertical extending track on at least one face of said column, and wherein said retaining and guide means comprises at least one locking slide configured to be connected to said tracks for vertical sliding movement therealong.

7. The improvement according claim 6 wherein said at least one locking slide further comprises a manual actuator for locking said slide at selected vertical locations along the track.

8. The improvement according to claim 1 wherein at least one vertically extending track is located in the patient room ceiling adjacent said medical service column, and wherein said securing means comprises at least one locking slide configured to be connected to said track for vertical sliding movement therealong.

9. The improvement according to claim 8 wherein said at least one locking slide further comprises a manual actuator for locking said slide at selected vertical locations along said track.

* * * * *